US006045885A

United States Patent [19]

Cheney

[11] Patent Number: 6,045,885

[45] Date of Patent: Apr. 4, 2000

[54] HIGH PRESSURE, HIGH TEMPERATURE GASKET

[76] Inventor: James E. Cheney, 579 Blandford Dr., Worthington, Ohio 43085

[21] Appl. No.: 09/144,873

[22] Filed: Sep. 1, 1998

[51] Int. Cl.[7] ..... B32B 1/08

[52] U.S. Cl. ..... 428/36.91; 428/212; 277/936; 277/938; 277/943; 277/946

[58] Field of Search ..... 428/36.91, 212; 277/938, 936, 943, 946

[56] References Cited

U.S. PATENT DOCUMENTS

| | | | |
|---|---|---|---|
| 2,941,248 | 6/1960 | Hall | 18/16.5 |
| 2,941,252 | 6/1960 | Bovekerk | 18/34 |
| 3,154,619 | 10/1964 | Brayman | 264/319 |
| 3,350,743 | 11/1967 | Ishizuka | 18/16.5 |
| 3,365,751 | 1/1968 | Ishizuka | 18/16.5 |
| 3,546,413 | 12/1970 | Ishizuka . | |
| 4,097,208 | 6/1978 | Ishizuka | 11/32 |
| 4,385,881 | 5/1983 | Ishizuka | 11/32 |
| 4,518,334 | 5/1985 | Ishizuka | 11/32 |
| 4,951,954 | 8/1990 | MacNeill | 277/936 |
| 5,190,734 | 3/1993 | Frushour . | |
| 5,244,368 | 9/1993 | Frushour | 3/8 |

*Primary Examiner*—Alexander Thomas
*Attorney, Agent, or Firm*—John L. Gray; Kegler, Brown, Hill & Ritter Co., LPA

[57] ABSTRACT

A gasket for high pressure, high temperature apparatus is disclosed which is of a generally frusto-conical shape. The smaller diameter portion of the gasket is made primarily from low friction material and the larger diameter portion of the gasket is made from a mixture of high friction material and low friction material, the low friction material being the major portion. The gasket may be made as two parts and joined or not joined together or by double filling a mold and pressing as a single unit.

5 Claims, 1 Drawing Sheet

HIGH PRESSURE, HIGH TEMPERATURE GASKET

BACKGROUND OF THE INVENTION

Almost all high pressure, high temperature apparatus with appreciable useful volume is gasketed in some manner. This gasketing seals the contents and the pressure volume and provides the pressure drop to the outside atmospheric pressure. While the earlier gaskets were made of naturally occurring materials, modern gaskets for the most part are mixtures of one or more low shear materials and one or more high shear materials mixed together with a binder. These are then pressed to a near net shape for gasketing parts. It is necessary to cure these parts in a controlled environment. On a typical Hall belt apparatus, the use of such gaskets results in the high shear material in the gasket in the tapered end of a die abrading the surface of the die. This process continues until cobalt and small carbide grains that make up the die are slowly removed. This creates a pit or depression that acts as a valley or focusing entity that lines up axially and continues to deepen. The result is localized areas of stress that can lead to a) slip in the carbide grains, advancing to b) micro cracking through the grains and further advancing to c) phase three crack growth and eventual failure. This type of damage leads to a marked reduction in expected fatigue life of the Hall type belt apparatus. In the Hall apparatus and in straight sided bore apparatus the high friction of the gasket material to the bore of the apparatus also creates pressure loss at the central portions of the apparatus.

BRIEF SUMMARY OF THE INVENTION

Applicant overcomes these disadvantages of the present gasket materials by making the gasket of two separate mixtures of materials. The gasket is of a generally frusto-conical shape and the smaller diameter portion of the gasket is made primarily from low friction material and the larger diameter portion of the gasket if made from a mixture of high friction material and low friction material, the low friction material being the major portion. This removes the hard high shear component from the bore region of the die to minimize the erosion and localized stress concentrations that this erosion causes and improves pressure distribution. The gasket could be made as two parts and joined or not joined together or by double filling a mold and pressing as a single unit.

It is therefore an object of this invention to provide a gasket for a high-pressure, high-temperature apparatus which will preserve the life of the apparatus and improve pressure distribution by use of the gasket.

This, together with other objects of the invention, will become apparent from the following detailed description of the invention and the accompanying drawings.

DETAILED DESCRIPTION OF THE INVENTION

For ease of description the Applicant's invention shall be described for a Hall belt-type apparatus but it is to be understood that it is to be adaptable to other high pressure, high temperature apparatus.

Figure 1:
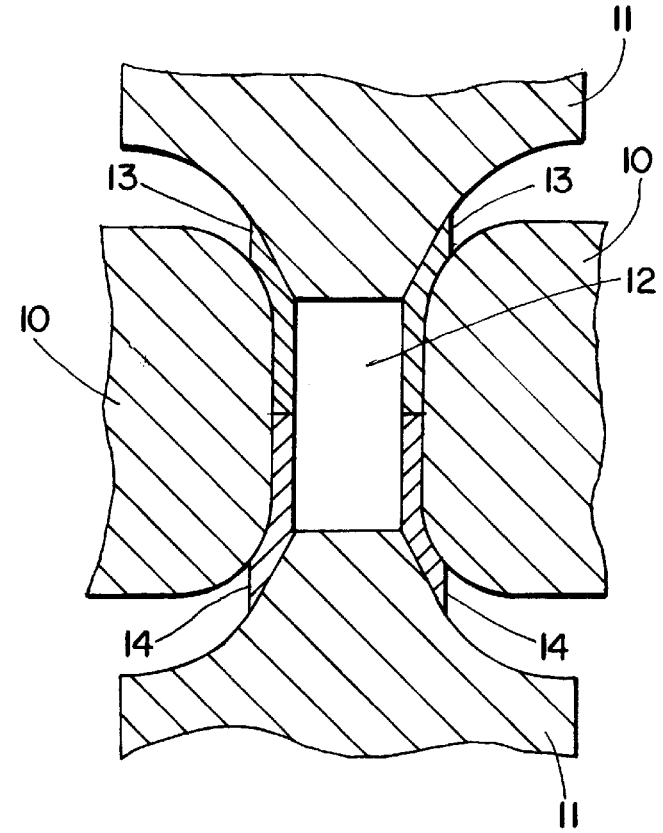
FIG. 1 shows a typical Hall belt apparatus in section.

Referring now to FIG. 1, which is a typical Hall belt apparatus, the die portions are shown at 10—10 and the two opposed movable pistons are shown at 11—11. The material to be subjected to high pressure, high temperature is shown at 12. The so called flower pot shaped gaskets are shown in section with the narrower open ends adjacent to each other. These are units 13 and 14. In operation the two pistons 11—11 are forced together compressing the material 12.

Figure 2:
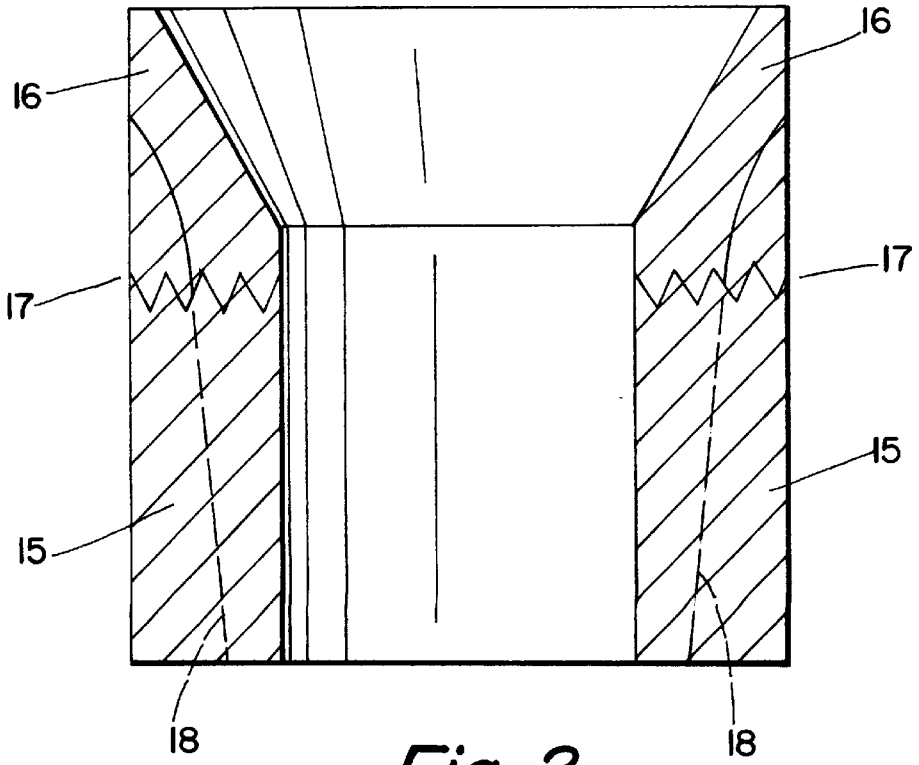
FIG. 2 is a sectional view of Applicant's gasket.

Referring to FIG. 2, there is shown one method of making Applicant's invention. A mold is filled with high friction material 15—15 containing a binder such as sodium silicate in the lower portion of the mold and the upper portion of the mold is filled with low friction material 16—16 also containing a binder such as sodium silicate. The joint between the two zones is 17—17. After pressing and fitting the final part shape is shown in dotted outline 18—18 with the lower portion containing the high friction material and the upper portion showing the low friction material.

Some of the low friction materials which can be used are talc, soap stone, steatite, sodium chloride, potassium chloride, cobalt chloride, silver chloride, cesium chloride, potassium bromide, copper bromide, sodium sulfate, sodium carbonate, Minnesotatte, Willemseite, ground Indian pipestone, South African Wonderstone, and other pyrophyllites, mica, graphite, boron nitride and clays. Higher temperatures will eliminate some materials in some applications.

Some of the high shear and high friction material that may be used are silicon carbide, tungsten carbide, iron oxide, aluminum oxide, magnesium oxide, zirconium oxide, silicon oxide, garnet, zircon, kianite, rutile, olivine, calcined talc and calcined pyrophyllite.

Binders include acetates, starches, gums, resins, phosphates and sodium silicate.

Rather then using the process above described to press out the gasket to its desired shape using a die, the two parts can be fabricated separately, one for the lower region and one for the upper region and used as separate parts or they can then later be joined with an appropriate binder such as mentioned above. Often times following the method of making the gasket using a die, it is necessary to cure the material. In addition to the closed die methods of making the gasket there are other methods which may be used. These methods are well know to those skilled in the art and are not recited in detail in this application.

While this invention has been shown and described with respect to a detailed embodiment thereof, it will be understood by those skilled in the art that various changes in form and detail thereof may be made without departing from the scope of the claims of the invention.

What is claimed is:

1. A gasket for a high pressure and high temperature apparatus, said gasket being of a generally frusto-conical shape, the smaller diameter portion of said gasket comprising primarily low friction material and the larger diameter portion of said gasket comprising some high friction material, said smaller and larger diameter portions of said gaskets being held together by a binder, said binder material being a material selected from the group consisting of acetates, starches, gums, resins, phosphates and sodium silicate.

2. A gasket for a high pressure and high temperature apparatus, said gasket being of a generally frusto-conical shape, the smaller diameter portion of said gasket comprising primarily low friction material and the larger diameter portion of said gasket comprising some high friction material wherein said high friction material comprises one or more materials selected from the group consisting of silicon carbide, tungsten carbide, iron oxide, aluminum oxide, magnesium oxide, zirconium oxide, silicon oxide, garnet, zircon, kianite, rutile, olivine, calcined talc and calcined pyrophyllite.

3. A gasket for a high pressure and high temperature apparatus, said gasket being of a generally frusto-conical shape, the smaller diameter portion of said gasket comprising primarily low friction material and the larger diameter portion of said gasket comprising some high friction material, said low friction material comprising one or more materials selected from the group consisting of talc, soap stone, steatite, sodium chloride, potassium chloride, cobalt chloride, silver chloride, cesium chloride, potassium bromide, copper bromide, sodium sulfate, sodium carbonate, Minnesotatte, Willemseite, ground Indian pipestone, South African Wonderstone, and other pyrophyllites, mica, graphite, boron nitride and clay and the high friction material comprises one or more materials selected from the group consisting of silicon carbide, tungsten carbide, iron oxide, aluminum oxide, magnesium oxide, zirconium oxide, silicon oxide, garnet, zircon, kianite, rutile and olivine.

4. The gasket of claim 3 wherein the smaller diameter portion of said gasket and the larger diameter portion of said gasket are held together by a binder.

5. The gasket of claim 4 wherein said binder is sodium silicate.

* * * * *